United States Patent [19]

Fukasawa et al.

[11] Patent Number: 4,708,822

[45] Date of Patent: Nov. 24, 1987

[54] METHOD OF SOLIDIFYING RADIOACTIVE SOLID WASTE

[75] Inventors: Tetsuo Fukasawa; Fumio Kawamura; Makoto Kikuchi, all of Hitachi, Japan

[73] Assignee: Hitachi, Ltd., Tokyo, Japan

[21] Appl. No.: 772,694

[22] Filed: Sep. 5, 1985

Related U.S. Application Data

[63] Continuation of Ser. No. 517,436, Jul. 26, 1983, abandoned.

[30] Foreign Application Priority Data

Jul. 26, 1982 [JP] Japan ..... 57-130163

[51] Int. Cl.[4] ..... G21F 9/16; G21C 21/00

[52] U.S. Cl. ..... 252/628; 264/0.5

[58] Field of Search ..... 427/5, 6; 264/0.5; 252/626, 628, 629, 633

[56] References Cited

U.S. PATENT DOCUMENTS

| | | | |
|---|---|---|---|
| 3,492,147 | 1/1970 | Young et al. | 427/5 |
| 3,669,299 | 6/1972 | Jones et al. | 252/626 |
| 3,798,123 | 3/1974 | Lindemer | 264/0.5 |
| 4,134,941 | 1/1979 | Hrovat et al. | 264/0.5 |
| 4,222,889 | 9/1980 | Uerpmann | 252/628 |
| 4,242,220 | 12/1980 | Sato | 264/0.5 |
| 4,257,912 | 3/1981 | Fleischer et al. | 252/626 |
| 4,268,409 | 5/1981 | Ga et al. | 264/0.5 |

FOREIGN PATENT DOCUMENTS

| | | | |
|---|---|---|---|
| 2655957 | 6/1978 | Fed. Rep. of Germany | 252/628 |
| 2748098 | 5/1979 | Fed. Rep. of Germany | 427/5 |
| 2819086 | 10/1979 | Fed. Rep. of Germany | 252/628 |
| 2473213 | 7/1981 | France | 252/628 |
| 0041800 | 3/1977 | Japan | 252/628 |
| 2107917 | 5/1983 | United Kingdom | 252/628 |
| 0502558 | 4/1979 | U.S.S.R. | 252/628 |
| 0550040 | 5/1979 | U.S.S.R. | 252/628 |

*Primary Examiner*—Stephen J. Lechert, Jr.
*Assistant Examiner*—Howard J. Locker
*Attorney, Agent, or Firm*—Antonelli, Terry & Wands

[57] ABSTRACT

A method of solidifying radioactive waste wherein radioactive solid waste of a predetermined shape are embedded in a solidifying material which has a modulus of elasticity that is equal to, or smaller than, the modulus of elasticity of said waste, to provide a solidified body.

The modulus of elasticity of the solidifying material is adjusted to be equal to, or smaller than, that of the radioactive solid waste, in order to prevent stress concentrations at the boundaries between the solidifying material and the radioactive solid waste, particularly on the solidifying material side thereof. The invention makes it possible to prepare a solidified body with a desired durability and safety factor.

2 Claims, 3 Drawing Figures

METHOD OF SOLIDIFYING RADIOACTIVE SOLID WASTE

This is a continuation of application Ser. No. 517,436, filed July 26, 1983, now abandoned.

Background of the Invention

The present invention relates to a method of solidifying radioactive waste, and more specifically to a method of solidifying radioactive solid waste having a predetermined shape such as that of a pellet.

Radioactive waste has heretofore been solidified by mixing dried and granulated radioactive waste into a solidifying material such as a plastic material or concrete. In this case, the solidifying material such as plastic or concrete admixed with the granulated waste could be regarded as a homogeneous material, and the strength of the solidifying material had to be increased simply to increase the strength of the solidified package.

In recent years, a method has been proposed in which the granulated waste is pelletized and is then embedded in the solidifying material (Japanese Patent Laid-Open No. 34,200/1977), in order to increase the ratio of waste material embedded, or to reduce its volume. To increase the strength of the material which is solidified by the above method, however, can not be accomplished simply by increasing the strength of the solidifying material. For example, when the solidified package is disposed at sea and is subjected to high pressures, cracks often develop at the boundaries between the solidifying material and the solidified waste embedded therein.

SUMMARY OF THE INVENTION

An object of the present invention is to provide a method of solidifying radioactive solid waste which is durable and which maintains a sufficiently large safety factor, i.e., which is not destroyed even under increased pressure conditions.

Another object of the present invention is to provide a method of solidifying radioactive solid waste so that it is suitable for sea disposal or ground disposal.

The method of solidifying radioactive waste of the present invention was achieved by studying the relationship of the modulus of elasticity of the solidifying material and the waste. According to the present invention, the modulus of elasticity of the solidifying material is adjusted to be equal to, or smaller than, that of the radioactive solid waste, in order to prevent stress concentrations at the boundaries between the solidifying material and the radioactive solid waste, particularly on the solidifying material side thereof. Thus the invention makes it possible to prepare a solidified package with a desired durability and safety factor.

If a plastic solidifying material is used, the objects of the invention can be accomplished by using a resin with a large distance between crosslinking points. If cement or any other inorganic solidifying material is used, the objects of the invention can be accomplished by adding a rubber-like binder or the like.

According to the present invention, solidified radioactive waste is obtained which does not develop stress concentrations within the solidified package even when high pressures are applied thereto, and which does not develop cracks which would lead to destruction, even under highpressure conditions such as on the seabed.

BRIEF DESCRIPTION OF THE DRAWINGS

FIG. 2 shows the dependency of the internal stress $\sigma$/P, normalized by external pressure, on the ratio $E_2/E_1$, from which it will be understood that when the modulus of elasticity $E_1$ of the radioactive solid waste is smaller than that $E_2$ of the solidifying material ($E_1 < E_2$), the stress $\sigma$ at the boundary therebetween is greater than the external pressure P. Therefore, if the safety factor is set simply by comparing the compressive strength of the solidifying material with the external pressure P, a sufficient durability is not often maintained under practical conditions.

Figure 1:
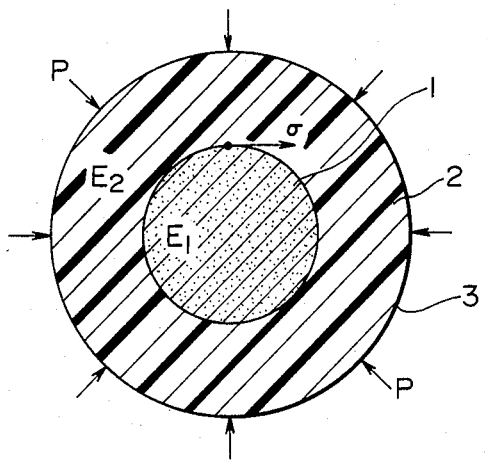
FIG. 1 is a simplified diagram which illustrates schematically a solidified package in which is embedded a piece of spherical, pelletized, radioactive solid waste.
Figure 2:
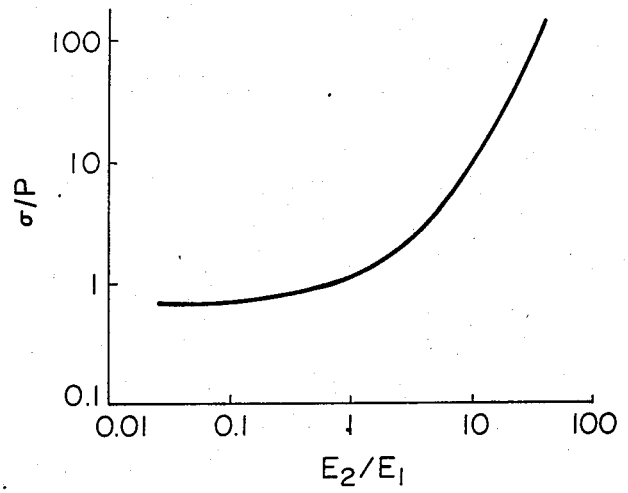
FIG. 2 is a graph of the dependency of tangential stress ($\sigma$/P) at the boundary of pellet in the solidified package, normalized by the external pressure applied to the solidified package, on the ratio ($E_2/E_1$) of the modulus of elasticity $E_1$ of radioactive solid waste to the modulus of elasticity $E_2$ of solidifying material.

The intensity of the stress concentrated at the boundary between the solid waste and the solidifying material is in inverse proportion to the radius of curvature of the surface of the solid waste. In practice, the radioactive waste consists of an aggregate of conduit pieces, waste cloth, plastic materials, as well as materials which have been dried, granulated, and pelletized, having a coarse surface and various radii of curvature. Therefore, the stress concentrates unevenly, unlike in the completely spherical representation of FIG. 1; i.e., the stress concentrates locally. With an actual solidified package, therefore, the inclination of the curve becomes steeper than that of FIG. 2, and the safety factor decreases greatly. This curve always passes through the point [$\sigma$/P, $E_2/E_1$]=[1, 1]. When the modulus of elasticity $E_2$ of the solidifying material is smaller than the modulus of elasticity $E_1$ of the radioactive solid waste, therefore, the stress does not become greater than the external pressure, and the safety factor does not decrease.

Steel material such as conduit pieces have a modulus of elasticity of $10^6$ kg/cm$^2$, waste cloth and plastic materials have moduli of elasticity in the range of $10^2$ to $10^3$ kg/cm$^2$, and materials obtained by drying concentrated liquid waste or ion-exchange resins, followed by pulverization and pelletization, have a modulus of elasticity of about $10^3$ kg/cm$^2$. Though it is not possible to adjust the modulus of elasticity $E_1$ freely, the modulus of elasticity $E_2$ of the solidifying material can be adjusted so that the ratio $E_2/E_1$ of moduli of elasticity becomes smaller than 1, in order to maintain the desired safety factor and to prevent the solidified package from being destroyed.

There now follows a description of an embodiment for solidifying radioactive solid waste according to the present invention wherein mirabilite pellets are embedded in a polyester resin, the mirabilite pellets being obtained by pelletizing a powder obtained by drying concentrated liquid waste from a boiling-water reactor. The mirabilite pellets employed in this embodiment had an almond shape, measure about 3 cm long, about 2 cm wide, and 1.3 cm thick, and were prepared according to a known process, i.e., the process disclosed in Japanese Patent Laid-Open No. 15078/1980. The modulus of elasticity of the mirabilite pellets as $3\times10^3$ kg/cm$^2$.

Figure 3:
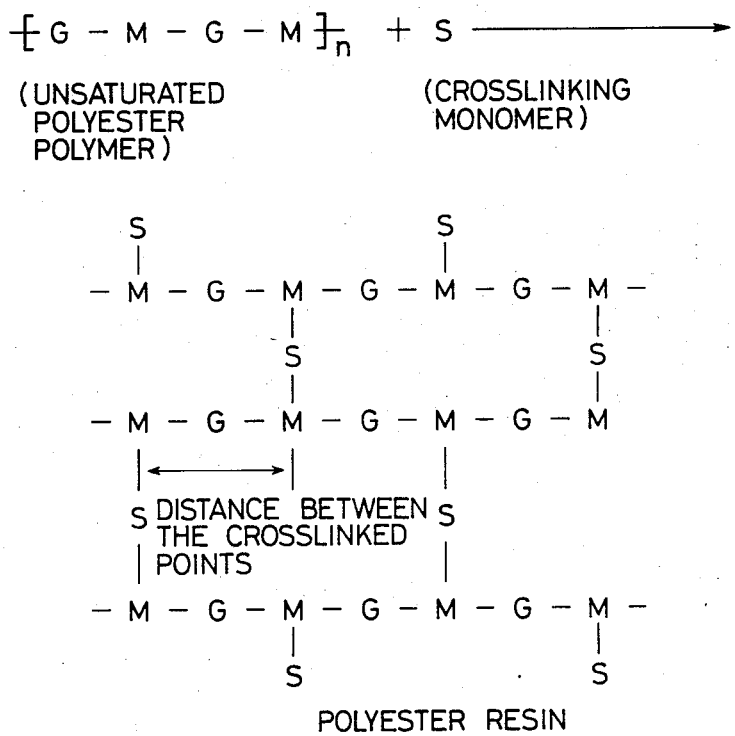
FIG. 3 is a diagram which illustrates schematically the crosslinking polymerization reaction of a plastic material which is used as the solidifying material in the present invention. cl DETAILED DESCRIPTION OF THE INVENTION In a solidified package 3 shown in FIG. 1, radioactive solid waste 1 assumes a spherical pelletized shape and is embedded in a solidifying material 2. If an external pressure P is applied to the solidified package 3, stress concentrates in the solidified package and particularly at the boundary between the solidifying material 2 and the radioactive solid waste 1, and tangential stress $\sigma$ which is a cause of cracking reaches a maximum. In this case, the intensity of the tangential stress is given as a function of the external pressure P, modulus of elasticity $E_1$ of the radioactive solid waste, and modulus of elasticity $E_2$ of the solidifying material.

For the solidifying material, a polyester resin was used, having properties as shown in Table 1, that was formed by the radical polymarization reaction of an unsaturated polymer with a crosslinked monomer. FIG. 3 is a schematic diagram illustrating the crosslinking polymerization reaction, in which the unsaturated polyester polymer consists of ester bonds of glycol G and unsaturated acid M. The distance between an unsaturated acid M and a neighboring unsaturated acid M across a glycol G is called the distance between crosslinking points. Therefore the distance between crosslinking points can be increased by using a glycol with a large molecular weight and a long chain. By using a polybutadiene glycol instead of the traditionally-used propylene glycol, the inventors have succeeded in increasing the distance between crosslinking points 7-fold and in reducing the modulus of elasticity to one-fiftieth the original value i.e., to $5\times10^2$ kg/cm$^2$).

250 kg of the mirabilite pellets were placed into a cage within a 200-liter drum, and the solidifying material was poured into fill the space between the drum wall and the mirabilite pellets with the solidifying material. The drum was left to stand and harden, thereby obtaining a solidified package. The solidified package was subjected to an sea disposal test simulating a depth of 6,500 meters (pressure of 650 kg/cm$^2$). The solidified package was not destroyed and no cracks developed. In this embodiment, the ratio $E_2/E_1$ of the modulus of elasticity of mirability pellets to the modulus of elasticity of polyester is 0.2 and, hence, it is considered that stress does not concentrate.

As a comparative example, a solidified package was also prepared using a customarily employed plastic material (details are shown in Table 1) with a high modulus of elasticity, and was subjected to the same test. In this case cracks developed, and the solidified package was partly destroyed. The ratio $E_2/E_1$ of the modulus of elasticity of the plastic material to the modulus of elasticity of the mirabilite pellets was about 10. That is, tangential stresses of 5 to 10 times as great concentrated at the boundaries between the plastic material and the mirabilite pellets if an external pressure of 500 kg/cm$^2$ was applied (which corresponds to a sea depth of 5,000 meters). The plastic material used as the solidifying material broke under a static water pressure of about 2,500 kg/cm$^2$. Therefore, the solidified package developed cracks, and was destroyed as the worst case.

TABLE 1

| | Plastic solidifying material used in the embodiment of the invention | Plastic solidifying material used in the comparative example |
|---|---|---|
| Unsaturated polyester monomer | Unsaturated alkyl containing polybutadiene glycol | Unsaturated alkyl containing propylene glycol |
| Crosslinking monomer | Styrene | Styrene |
| Features | Long distance between crosslinking points (molecular weight of up to 2,000), and small modulus of elasticity ($5\times10^2$ kg/cm$^2$) | Short distance between crosslinking points (molecular weight of up to 300), and large modulus of elasticity ($3\times10^4$ kg/cm$^2$) |

According to the present invention, the solidifying material is not limited to a plastic but could also be cement. In this case, the cement may have natural rubber or synthetic rubber latex mixed therewith to adjust the modulus of elasticity of the cement to be within the range of about $10^4$ kg/cm$^2$ to $10^2$ kg/cm$^2$, so that the modulus of elasticity is smaller than that of the radioactive solid waste.

When more than one kind of radioactive solid waste are to be treated, the modulus of elasticity of the solidifying material should, of course, be based upon the smallest modulus of elasticity of the wastes.

What is claimed is:

1. A method of solidifying radioactive waste which comprises embedding mirabilite pellets that are obtained by drying, granulating and pelletizing radioactive solid waste, directly in a solidifying material to provide a solidified package; the solidifying material being a crosslinked plastic resin with a large distance between crosslinked points and having a modulus of elasticity that is smaller than the modulus of elasticity of the mirabilite pellets and the plastic resin being not greater than an external pressure applied to the solidified package, wherein the plastic resin is a polymer consisting of a styrene and an unsaturated polyester which contains a polybutadiene glycol, and the mirabilite pellets have a modulus of elasticity on the order of $10^3$ Kg/cm$^2$ and the plastic resin has a modulus of elasticity on the order of $10^2$ Kg/cm$^2$.

2. A method of solidifying radioactive waste which comprises embedding mirabilite pellets that are obtained by drying, granulating and pelletizing radioactive waste, directly in a solidifying material to provide a solidified package, wherein the solidifying material is cement which contains a rubber-like binder and has a modulus of elasticity that is smaller than the modulus elasticity of said mirabilite pellets, and further a tangential stress $\sigma$ at a boundary between a solid mirabilite pellets and the cement is not greater than an external pressure applied to the solidified package; and the mirabilite pellets having a modulus of elasticity on the order of $10^3$ Kg/cm$^2$ and the plastic resin having a modulus of elasticity on the order of $10^2$ Kg/cm$^2$.

* * * * *